United States Patent [19]

Mucciarone

[11] Patent Number: 4,712,714

[45] Date of Patent: Dec. 15, 1987

[54] SEALING SPOUT FOR PAPER CARTONS

[76] Inventor: Domenick Mucciarone, 3645 Boca Ciega Dr., Apt. 206, Naples, Fla. 33942

[21] Appl. No.: 59,186

[22] Filed: Jun. 11, 1987

Related U.S. Application Data

[63] Continuation of Ser. No. 865,460, May 21, 1986, abandoned.

[51] Int. Cl.[4] ..... B67B 7/26

[52] U.S. Cl. ..... 222/91

[58] Field of Search ..... 222/91, 87, 81, 90, 222/80, 89; 411/411

[56] References Cited

U.S. PATENT DOCUMENTS

| | | | |
|---|---|---|---|
| 105,818 | 7/1870 | Lord | 222/91 |
| 1,778,449 | 10/1930 | Cushing | 222/91 |
| 3,768,698 | 10/1973 | Corty, Sr. et al. | 222/91 |
| 3,973,698 | 8/1976 | Kato | 222/91 |

FOREIGN PATENT DOCUMENTS

| | | | |
|---|---|---|---|
| 404428 | 8/1963 | Switzerland | 222/91 |

*Primary Examiner*—F. J. Bartuska
*Assistant Examiner*—Kenneth Noland

[57] ABSTRACT

A device for removing the liquid contents from a sealed paper carton. Preferably made of a high strength thermoplastic material, the device consists of a pouring spout, a removable plug for the spout, a sealing ring surrounding the base of the spout, and a sharply tipped, spirally grooved hollow cone which depends axially from the sealing ring. The underside of the sealing ring contains an annular ring-shaped recess formed by the base of the cone and the lower edge of the sealing ring. The spiral groove in the cone is arcuate in cross-section and contains a plurality of cylindrical holes which provide passageways from the outside of the cone into the interior of the spout.

4 Claims, 5 Drawing Figures

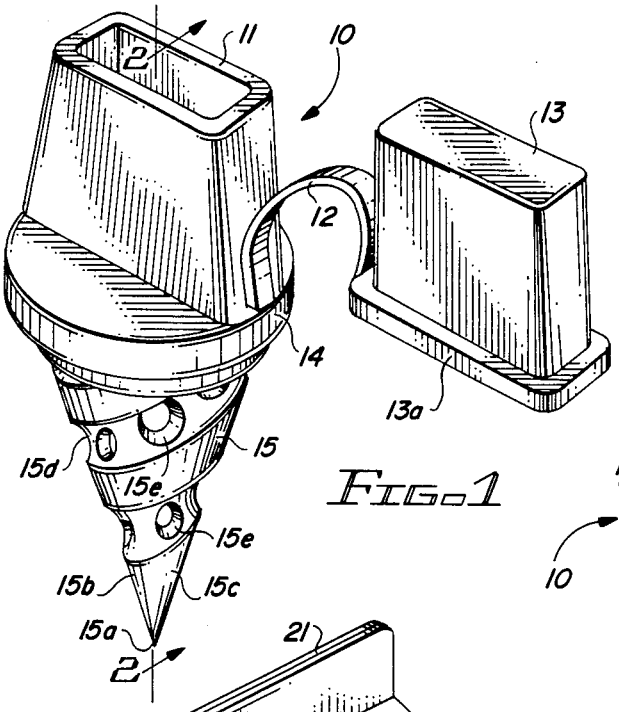
FIG. 1
FIG. 2
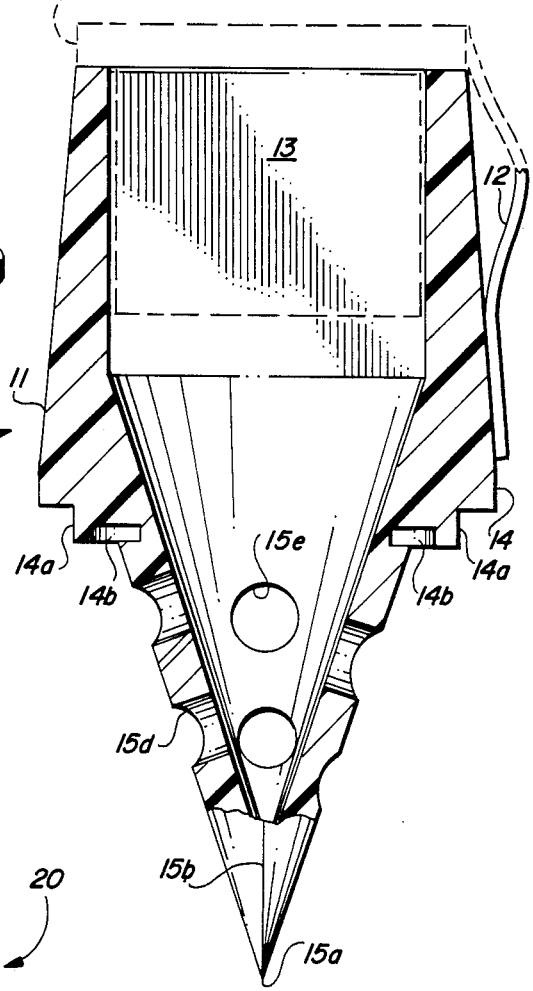
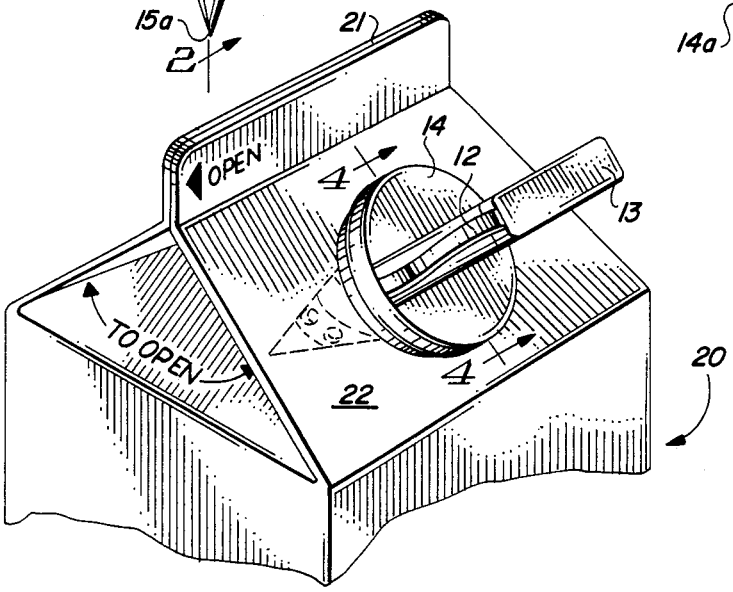
FIG. 3
FIG. 4
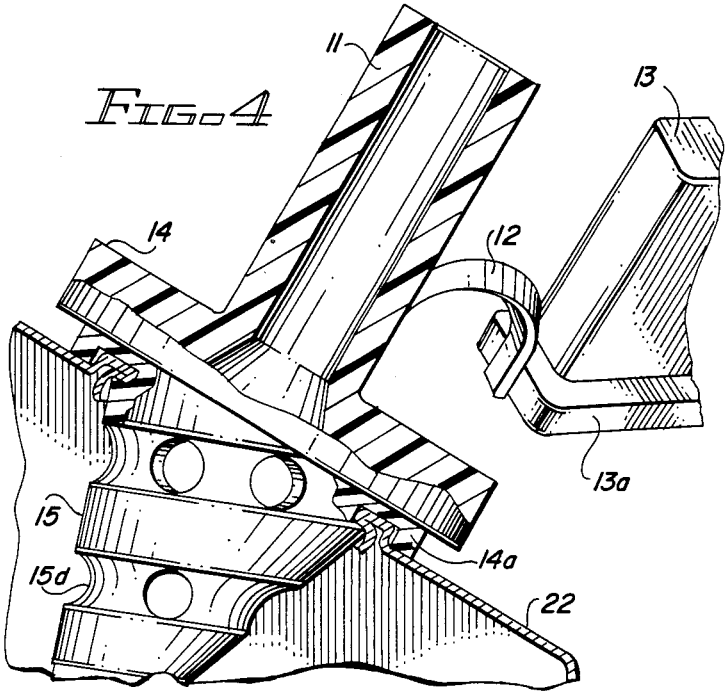
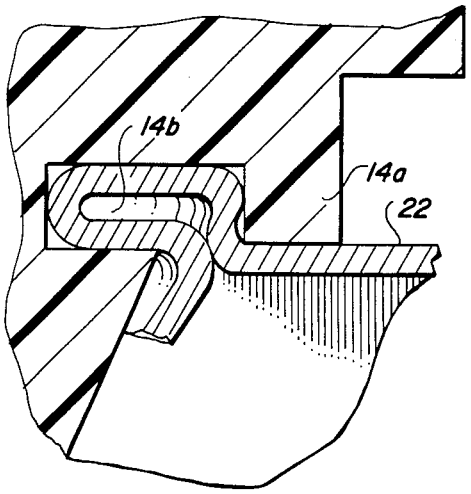
FIG. 5

SEALING SPOUT FOR PAPER CARTONS

This is a continuation of co-pending appliction Ser. No. 865,460, filed on May 21, 1986, now abandoned.

BACKGROUND AND SUMMARY OF THE INVENTION

I have invented a device which permits removal of the liquid contents of a conventional sealed paper carton without opening the carton in the usual manner. The device can be used either as a spout to pour the liquid contents of the paper carton into a glass or other receptacle or as a mouthpiece to drink directly out of the carton.

Paper cartons are widely used as containers in marketing fresh milk, cream, orange and other juices, and many other liquids. As such, paper cartons possess many advantages in convenience and economy which have lead to their widening use especially in supermarkets and convenience stores in sizes ranging from half-gallons to half-pints.

Despite their many advantages, conventional paper cartons as presently manufactured and sealed possess two major disadvantages. First, they are difficult to open in the manner the manufacturer intends them to be opened, even for persons with strong hands. Rather than the simple two-handed opening promised by following the directions printed on the carton, the person opening the sealed carton is often required to use a knife or other utensil to pry open the spout formed by the upper edges of the "open here" side of the carton. And for elderly persons and those with hands weakened by arthritis, opening a sealed half-gallon carton of milk is often impossible.

A second disadvantage of opening sealed paper cartons in the manner intended by the manufacturer is that they cannot be reliably re-sealed, thus no longer being transportable without danger of spilling and leaving such liquid contents as milk liable to spoilage.

The foregoing disadvantages of using paper cartons containing liquids are eliminated by using my device for removing the liquid from the carton. My unique device, which I have named Spik-It, is inserted into the inclined top of a sealed and unopened carton and used as a pouring spout or a mouthpiece to drink from the carton. When the carton has been emptied of its contents, my Spik-It can be removed and re-used again and again.

My Spik-It device is preferably made of a high density thermoplastic material such as acrylic and comprises three interconnected parts: a spout preferably having an elongated rectangular opening and a flanged plug for the opening; a cylindrical disk-shaped sealing ring; and a spirally grooved hollow cone whose tip is formed by two intersecting knife-like edges and whose spiral grooves contain a plurality of holes.

To use, the sharp tip of the Spik-It is forcefully inserted into the center of one of the two inclined top sides of the paper carton, such entry being facilitated by the two intersecting knife-like edges at the tip of the cone. Then, using the rectangular spout as a key, the cone of the Spik-It is twisted clockwise into the wall of the carton until the lower surface of the sealing ring rests firmly against the outer surface of the carton.

Surprisingly, as the cone is twisted into the carton, paper picked up in the grooves of the cone folds and is forced inwardly into an annular groove in the lower edge of the ring where a double layer of the paper carton forms a liquid-tight sealing washer as the ring comes into contact with the outer surface of the carton.

Thus inserted and twisted firmly into liquid-tight engagement with the paper carton and with the rectangular spout lying in a horizontal position, by tipping the carton its liquid contents can be poured or drunk as desired without danger of leaking or dripping. And when the partially empty carton is to be transported or stored, the flanged plug is inserted into the spout to seal the carton and prevent spillage or spoilage of the remaining liquid contents.

My Spik-It device can be made in different sizes, those with larger cones and spouts being adapted for rapid pouring of the contents of large cartons, and those with smaller cones and spouts being adapted for use with small cartons of orange juice and similar liquids designed for drinking directly from the carton.

BRIEF DESCRIPTION OF THE DRAWINGS

FIG. 1 is an overall perspective view of a preferred embodiment of my pouring device showing the flanged plug attached to the spout by a flexible cord.

FIG. 2 is a cross-sectional view taken along line 2—2 of the device shown in FIG. 1 with the plug having been inserted into the spout.

FIG. 3 is a perspective view of the device screwed and sealed into the inclined top side of a conventional sealed paper carton.

FIG. 4 is a cross-sectional view partially broken away taken along line 4—4 of the device shown in FIG. 4 with the plug removed from the spout.

FIG. 5 is a detailed view of the device in FIG. 4 showing in greater detail the wall of the paper carton folded into the annular recess in the device to form a liquid-tight seal between the device and the carton.

DETAILED DESCRIPTION OF THE PREFERRED EMBODIMENT

Referring to the drawings, FIG. 1 is an overall view of my Spik-It TM device 10 whose major components are preferably made of clear high density acrylic material.

Spik-It 10 comprises three interconnected components; namely, a preferably rectangular spout 11 to which, by a flexible cord 12, is attached a flanged plug 13 sized to fit snugly into spout 11: a disk-shaped sealing ring 14 at the base of spout 11 whose function will be later described: and a spirally grooved hollow cone 15 having a tip **15*a* formed by knife-like edges 15*b* and 15*c* and also having a spiral arcute groove 15*d*. Groove 15*d* contains a plurality of circular holes 15*e* which provide passageways from the outside of the cone to the inside of spout 11**.

Plug 13 is sized to fit snugly into the opening in spout 11 so as to securely close the opening. Preferably the plug contains a flange **13*a*** to insure complete sealing of the spout and to assist in removing the plug from the spout when desired.

Sealing ring 14 is axially aligned with hollow cone 15 and the lower half of ring 14 is of somewhat reduced diameter from the upper half. A ring-shaped annular recess **14*b* is formed in the ring's lower half as is best shown in FIG. 2 with the base of cone 15 serving as the inside vertical wall of recess 14*b* and the lower edge of the ring serving as a shoulder 14*a* providing the outer vertical wall of recess 14*b***.

FIGS. 3, 4 and 5 show the attachment of my Spik-It device 10 onto a conventional sealed paper carton 20.

Preferably my device is attached to the inclined top side 22 of carton 20 with its top edges 21 still sealed as shown in FIG. 3.

Grasping spout 11, the sharp tip 15*a* is forcefully inserted into the center of inclined top side 22 of the paper carton. Easy entry through the carton is assured by knife-like edges 15*b* and 15*c*. Using rectangular spout 11 as a key, cone 15 is twisted clockwise into carton 20 until the lower face of sealing ring 14 rests against the outer surface of carton side 22.

As cone 15 is twisted into the carton, paper pressed into the cone's spiral groove 15*d* is picked up and forced into annular recess 14*b* in the lower edge of ring 14 as shown in FIGS. 4 and 5. As the surface of carton side 22 comes into contact with the lower edge of ring 14, the double layer of paper forced into recess 14*b* will act as a liquid-tight sealing washer.

With my Spik-It device 10 inserted and then twisted into liquid-sealing attachment with paper carton 20 and rectangular spout 11 preferably in a horizontal position as shown in FIG. 3, carton 20 may be tipped up causing its liquid contents to flow through holes 15*e* into the hollow interior of cone 15 and into and out of spout 11 to be poured into a container or drunk as desired. Thus the liquid contents can be withdrawn without the danger of leaking or dripping.

Then when a partially empty carton 20 is desired to be stored or transported, flanged plug 13 is inserted into spout 11. Flange 13*a* assists plug 13 to seal spout 11 and thus prevent spilling and spoiling of the liquid remaining in carton 20.

While I have shown and described a preferred embodiment of my invention, the device can be made in various sizes and different forms as will be apparent to those skilled in the art. However, what I have shown and described should not be taken to limit my invention whose scope and spirit are limited only by the appended claims.

I claim:

1. A device for removing liquid from a sealed paper carton comprising a pouring spout which is rectilinear in cross section, a sealing ring surrounding the base of said spout, and a sharply tipped hollow cone depending axially from said sealing ring having a flat smooth geometrically conical outer surface and a single groove therein which groove spirally extends from the tip of the cone to the underside of the sealing ring and which is concavely arcuate in cross-section.

the flat underside of said sealing ring containing a single annular ring-shaped recess, one side of which is formed by the base of said cone and the other side is formed by the lower edge of the sealing ring, and the spiral groove in said cone contains a plurality of holes providing passageways from the outside of said cone into the interior of said spout.

2. A device as set forth in claim 1 which includes a flanged plug sized to fit snugly into the liquid-dispensing passageway in the pouring spout.

3. A device as set forth in claim 1 in which the sharp tip of the cone is formed by the intersection of two knife-like edges on the cone.

4. A device for removing the contents of a sealed paper carton comprising a pouring spout which is rectilinear in cross section, a plug sized to fit snugly into the pouring spout, a sealing ring surrounded and attached to the base of said pouring spout, and a sharp tipped hollow cone projecting axially from beneath said sealing ring having a flat smooth geometrically conical outer surface and a single groove therein spiraling from from the tip of the cone to said sealing ring.

the flat underside of the sealing ring containing a single annular ring-shaped recess whose sides are formed by the base of said cone and the lower edge of the sealing ring, the spiral groove in said cone is concavely arcuate in cross-section and contains a plurality of holes providing passageways from the outside of said cone into the interior spout, and the sharp tip of the cone is formed by the intersection of two knife-like edges on the cone.

* * * * *